United States Patent [19]

Dunne

[11] 4,089,257

[45] May 16, 1978

[54] VENTILATION GRILLE OR GRATING

[75] Inventor: James Dunne, Merseyside, England

[73] Assignee: Engineers & Metalworkers Ltd., England

[21] Appl. No.: 679,949

[22] Filed: Apr. 26, 1976

[30] Foreign Application Priority Data

May 30, 1975 United Kingdom ..... 23566/75

[51] Int. Cl.[2] ..... F24F 13/00

[52] U.S. Cl. ..... 98/121 R; 52/473

[58] Field of Search ..... 98/110, 114, 121 R; 15/238; 52/473, 664, 665

[56] References Cited

U.S. PATENT DOCUMENTS

| | | | |
|---|---|---|---|
| 578,728 | 3/1897 | Doten | 52/665 |
| 1,951,653 | 3/1934 | Green | 52/473 |
| 2,007,716 | 7/1935 | Green | 98/121 R |
| 2,972,358 | 2/1961 | Hinden | 98/121 R X |
| 3,217,631 | 11/1965 | Thompson et al. | 98/121 R |
| 3,892,054 | 7/1975 | Matson | 52/665 |

*Primary Examiner*—Ronald C. Capossela
*Attorney, Agent, or Firm*—William Anthony Drucker

[57] ABSTRACT

The invention relates to a grille or grating for fitting in the floor or wall or ceiling of an enclosed space, for example at the terminal outlet of a ventilating or air conditioning duct, and provides a grille which comprises a plurality of blades of generally rectangular cross-section which are press-fitted into spacedly arranged slots of a series of mullions. Said blades are received in said slots by spring clips located one in each slot and which clips have projections which lock said clips in said slots when the blades are inserted and reverse barbs which prevent withdrawal of said blades.

4 Claims, 3 Drawing Figures

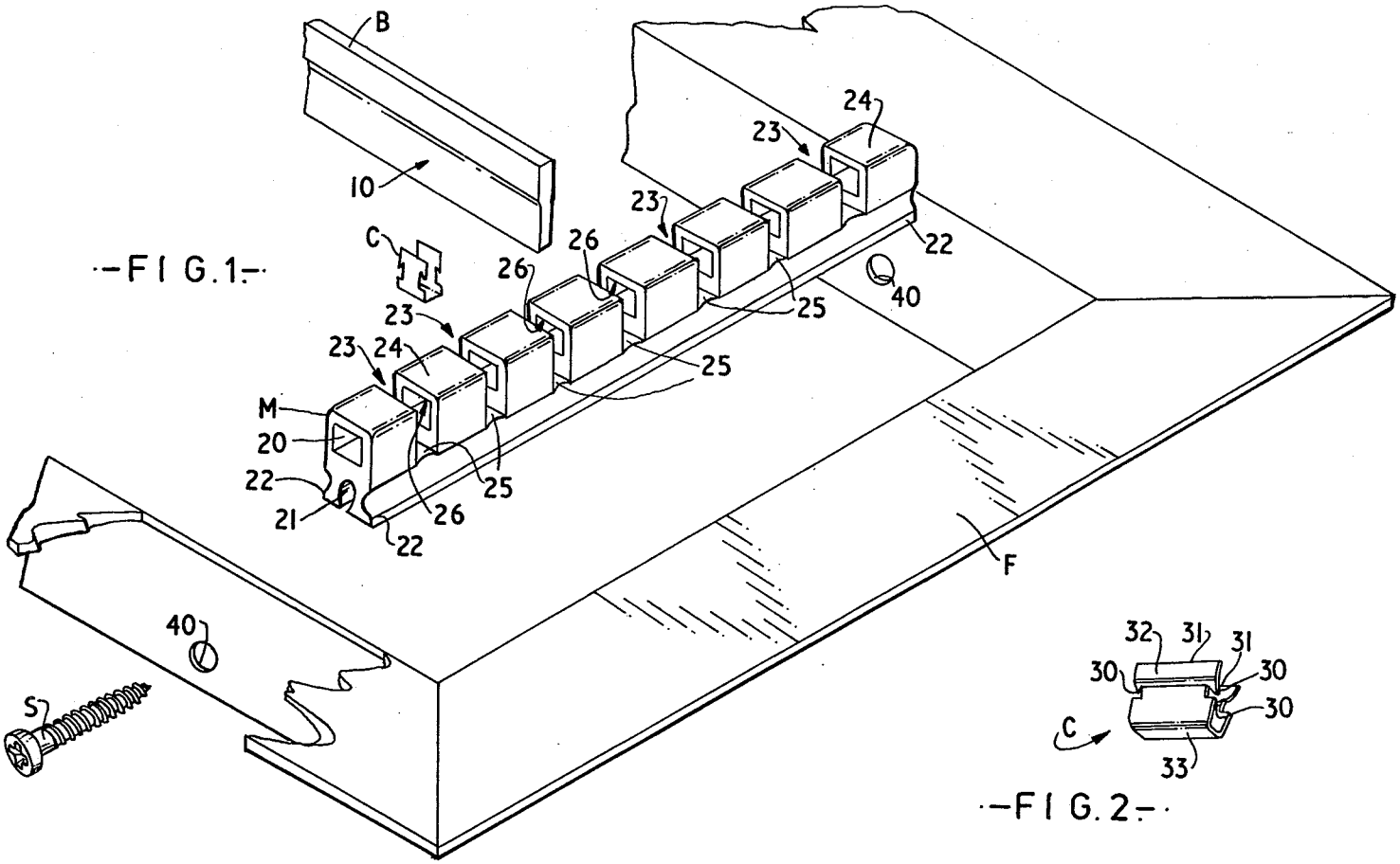
-FIG. 1-
-FIG. 2-

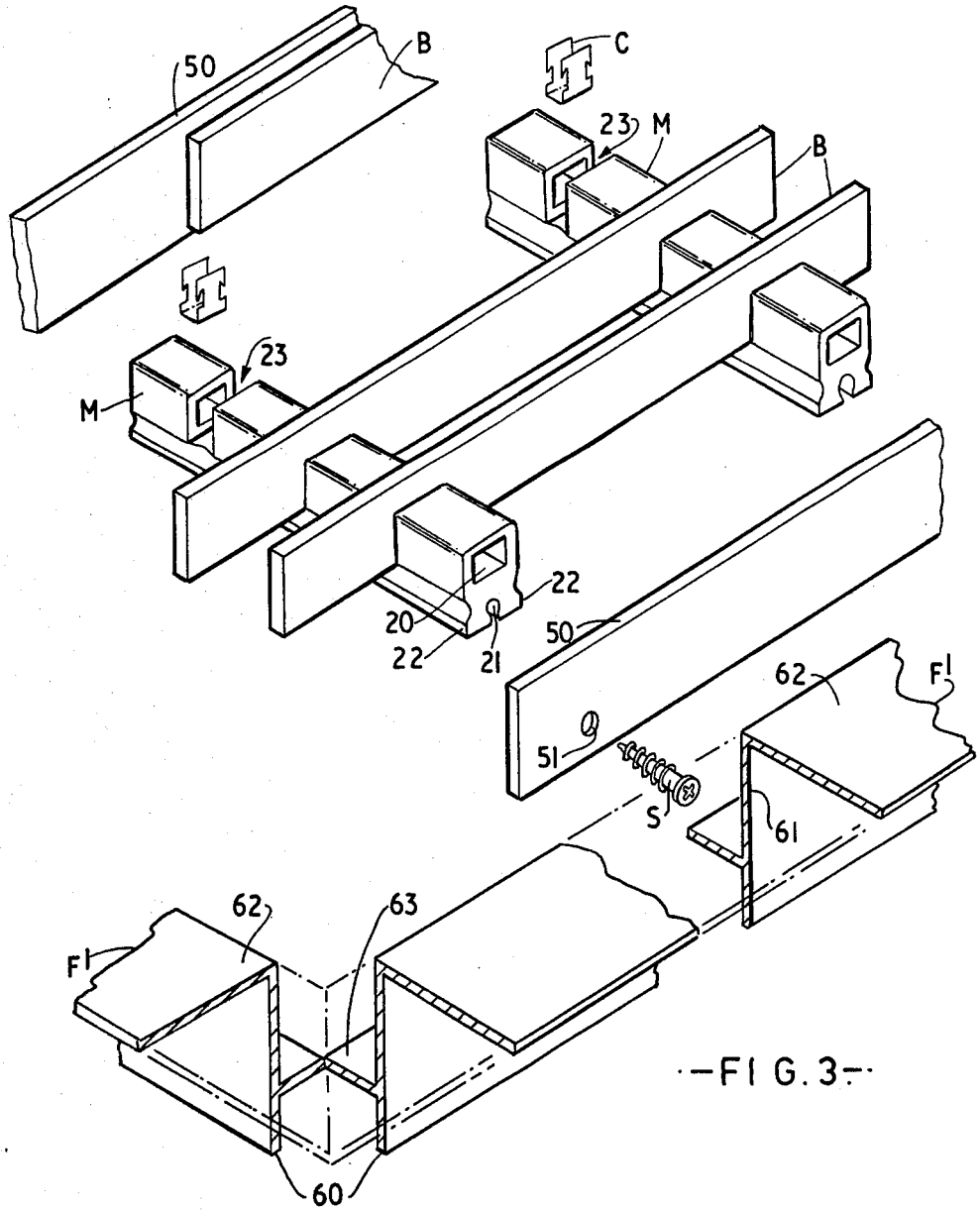
-FIG. 3-

VENTILATION GRILLE OR GRATING

This invention relates to grilles or gratings (hereinafter referred to as a "grille") for fitting in the floors, walls or ceilings of enclosed spaces, as for example at the terminal outlets of ventilating ductings, and has for its object an improved form of grille the component parts whereof are all extruded sections, and the assembly whereof can be effected by simple press-fitting of the parts together without the need for employing brazing, soldering or welding techniques.

Broadly, according to the invention, a ventilating grille comprises a plurality of blades or rectangular cross-section, and a series of mullions slotted to receive said blades in required spaced, parallel disposition, characterised in that said blades are received in said slots by spring clips located therein which have projections which lock said clips in said slots when the blades are inserted therein, and reverse barbs which prevent withdrawal of a blade when once inserted.

Preferably said mullions have grooves or channels extending axially thereof whereby said grille may be inserted in a surrounding frame and secured therein by screws extending through appertures of said frame into the said axial grooves or channels of said mullions.

Alternatively, end plates may be fitted to said mullions and the grille assembly simply seated in a surround having an inwardly directed seating flange. This latter arrangement is suitable for floor or cill line applications. The invention is further described with the aid of the accompanying drawings which illustrate by way of example only two embodiments.

In said drawings;

FIG. 1 is an exploded perspective view of a ventilating grille according to the invention in an early stage of assembly, together with a surrounding frame.

FIG. 2 is a perspective view showing in more detail a spring clip as used to lock the blades of the grille in assembled position.

FIG. 3 is an exploded sectional view of a grille for use with an alternative form of surround.

Referring to FIGS. 1 and 2, a ventilating grille according to the invention comprises a plurality of blades B of generally rectangular cross-section and a series of mullions M. When assembled, the grille is located within a frame or surround F. The components are preferably manufactured from aluminuim or an aluminium alloy. The blade B in this particular instance is formed with its lower part 10 of reduced thickness.

The mullion M is of a rectangular cross-section formed with a through rectangular bore 20 in its upper part, and an axial groove or channel 21 extending its full length in its under surface. The lower part of the section is reduced at each side so as to provide shoulders 22. Said mullion M is provided at uniformed spacings with transverse grooves or slots 23 which extend from the upper face 24 of the section to a point just short of the groove or channel 21. In each of said slots 23 is inserted a spring clip C composed of a suitable hard steel, e.g. carbon steel. Said clip C is generally of "U" section formed at each side of each leg with reversely, i.e. downwardly directed, barbs or teeth 30. The extremities 31 of each leg are outwardly curved as at 32. The depth of each clip C is such that when it is inserted in a slot 23 with its underside 33 in abuttment with the bottom 25 of said slot, then the extremities 31 are located just below the adjacent upper edges 26 of the bore 20. The width of the clip C is somewhat less than the width of the bore 20.

When a blade B is pressed fully home in a slot 23 it becomes located between the arms of the respective clip C and spreads said arms so that the extremities 31 of the clip engage below the adjacent edges 26 of the bore 20. Thus, the clip becomes immovably locked within the slot 23. Also, the reversely directed barbs or teeth 30 of the clip bite into the sides of the blade B and positively prevent its removal.

It will be seen that a grille or grating according to the invention can be readily and fixedly assembled by merely press-fitting a plurality of blades B into the provided slots 23 of two or more suitably arranged mullions M. Further as the components C and M are extrudable sections, any size of grille can be assembled by cutting the components to desired length.

The assembled grille can be locked in the surrounding frame F by self-tapping screws S entered through provided apertures 40 of the frame into the ends of the grooves or channel 21 of the mullions M. In the present instance the frane F is composed of four suitably mitred components of angle section.

Referring to FIG. 3, wherein like characters of reference have been used to denote parts which are like or equivalent to those illustrated and described in FIGS. 1 and 2, this illustrates a grille adapted to be removably seated within a frame F' or any similar aperture located say in the floor or cill of a room.

In this instance the mullions M of the grille are fitted at each end with terminal bars 50 apertured at 52 to receive self-tapping screws S which are screwed into the respective ends of the mullions M. The frame F' is constructed from components 60 each of which comprises a web 61 and upper and lower opposedly directed flanges 62, 63. The lower flanges 63, being inwardly directed, constitute an all round support upon which the grille assembly can be firmly seated.

I claim:

1. A ventilating grille comprising:
   (i) a plurality of blades of generally rectangular cross-section disposed parallel in spaced relationship,
   (ii) a plurality of mullions disposed parallel in spaced relationship, each said mullion having a plurality of transverse slots in each of which a respective blade is received, each mullion being of generally rectangular cross-section and having a rectangular through bore opening into said slots,
   (iii) a plurality of spring clips disposed one in each said slot, each spring clip being of "U" section and formed at each side of each leg with inwardly directed barbs, the extremity of each leg being outwardly curved and located just below the adjacent upper edge of said bore, the width of each clip being less than the width of said bore, said leg extremities abutting against the adjacent upper edge of the bore to retain the clip in the mullion, said barbs engaging into the blade to prevent withdrawal of the blade from the clip.

2. A ventilating grille, as claimed in claim 1, wherein said mullions having axially extending grooves to receive screws for securing the grille in a required position.

3. A ventilating grille, as claimed in claim 1, fitted in a surrounding frame comprising four mitred and connected components of angle section.

4. A ventilating grille, as claimed in claim 1, wherein terminal bars are fitted to the mullions at each end, and said grille is removably seated within frame components each comprising a web with upper and lower oppositely directed flanges, said lower flanges providing an all round support for the grille.

* * * * *